US005505116A

United States Patent [19]

Pantoja

[11] Patent Number: 5,505,116

[45] Date of Patent: Apr. 9, 1996

[54] STRINGING ACCESSORY FOR STRINGED MUSICAL INSTRUMENTS

[76] Inventor: Arthur Pantoja, 556 Liberty, El Cerrito, Calif. 94530

[21] Appl. No.: 508,621

[22] Filed: Jul. 28, 1995

[51] Int. Cl.[6] ..... G10G 7/00

[52] U.S. Cl. ..... 84/458

[58] Field of Search ..... 84/304, 453, 454, 84/458

[56] References Cited

U.S. PATENT DOCUMENTS

| | | | |
|---|---|---|---|
| 3,706,254 | 6/1995 | Morin | 84/304 |
| 4,791,849 | 12/1988 | Kelley | 84/458 |
| 5,272,953 | 12/1993 | Koch | 84/458 |
| 5,410,939 | 5/1995 | Matamoros et al. | 84/458 |

*Primary Examiner*—Patrick J. Stanzione

*Attorney, Agent, or Firm*—Harris Zimmerman

[57] ABSTRACT

Installation and tuning of strings on a musical instrument is aided by an accessory having a socket which fits onto the heads of the string engaging pegs of the instrument. A lever extends sidewardly from the socket and an elongated handle extends from the lever at right angles to the lever. The lever and handle jointly form a crank which facilitates turning of the pegs to tension or loosen strings. The accessory includes a cutter for cutting the strings. In the preferred form, the handle has a first portion which is directly attached to the lever and a second portion which is pivotable between a first orientation at which it extends in parallel relationship with the first portion and a second orientation at which it is angled relative to the first portion. Inserts on each of the handle portions have sharp cutting edges located to be in sliding contact with each other as the second handle portion is pivoted towards the first orientation.

12 Claims, 2 Drawing Sheets

STRINGING ACCESSORY FOR STRINGED MUSICAL INSTRUMENTS

TECHNICAL FIELD

This invention relates to musical instrument accessories and more particularly to devices for facilitating re-stringing of stringed musical instruments.

BACKGROUND OF THE INVENTION

A variety of musical instruments have strings which must be periodically replaced and which must be precisely tensioned in order to produce a particular musical note. Guitars, violins and cellos are among other examples of instruments of this kind. In most instruments of this type one end of each string is fixed to a component of the instrument and the other end wraps around a peg which can be manually turned to tension the string. The peg typically has a small blade which can be grasped between one's thumb and forefinger in order to turn the peg.

Accessories have heretofore been designed for the purpose of facilitating tightening and tuning of the strings of instruments of this kind. Such accessories have a body with an elongated socket proportioned to fit onto a peg of the instrument. A lever extends from the socket to facilitate turning of the peg. The lever may be in the form of a crank having a rotatable handle.

Prior accessories of this kind make it easier to turn the pegs and in some cases are also useful in connection with removal of pegs. It would be advantageous if the accessory also facilitated other operations that are involved in the re-stringing of a musical instrument.

The present invention is directed to overcoming one or more of the problems discussed above.

SUMMARY OF THE INVENTION

In one aspect of the present invention an accessory facilitates installation of strings on stringed musical instruments of the type having turnable pegs that engage the strings. The accessory has an elongated socket proportioned to fit onto a peg of the instrument and a lever extends from the socket to facilitate turning of the peg. The accessory further includes a cutter for cutting the strings.

In another aspect, the invention provides a musical instrument accessory which includes a socket having a face with an elongated opening proportioned to engage the string tensioning pegs of a stringed instrument. A lever extends outward from the socket and an elongated handle is attached to the lever at a location thereon that is spaced apart from said socket. The handle extends in a direction that is substantially at right angles to the face of the socket. The handle has a first handle portion which is directly attached to the lever and a pivoting second handle portion which extends alongside the first portion at a first orientation of the second portion and which extends at an angle relative to the first portion at a second orientation of the second portion. The second portion of the handle is attached to the first handle portion by a pivot coupling. First and second cutting inserts are secured to the first and second handle portions respectively at corresponding locations thereon which locations are spaced away from the pivot coupling. The cutting inserts have sharp cutting edges located to be in sliding contact with each other as the second handle portion is pivoted toward the first orientation of the handle portion.

The invention makes it easier to replace the strings of any of variety of stringed instruments of the type having pegs that are turned to engage strings to the instrument and to tension and tune the strings. The accessory enables cutting of the strings in addition to providing leverage during the process of turning the pegs thereby dispensing with any need to have a separate cutting tool during re-stringing of the instrument.

The invention, together with further aspects and advantages thereof, may be further understood by reference to the following description of the preferred embodiment and by reference to the accompanying drawings.

DETAILED DESCRIPTION OF THE DRAWINGS

DETAILED DESCRIPTION OF THE PREFERRED EMBODIMENT

Figure 1:
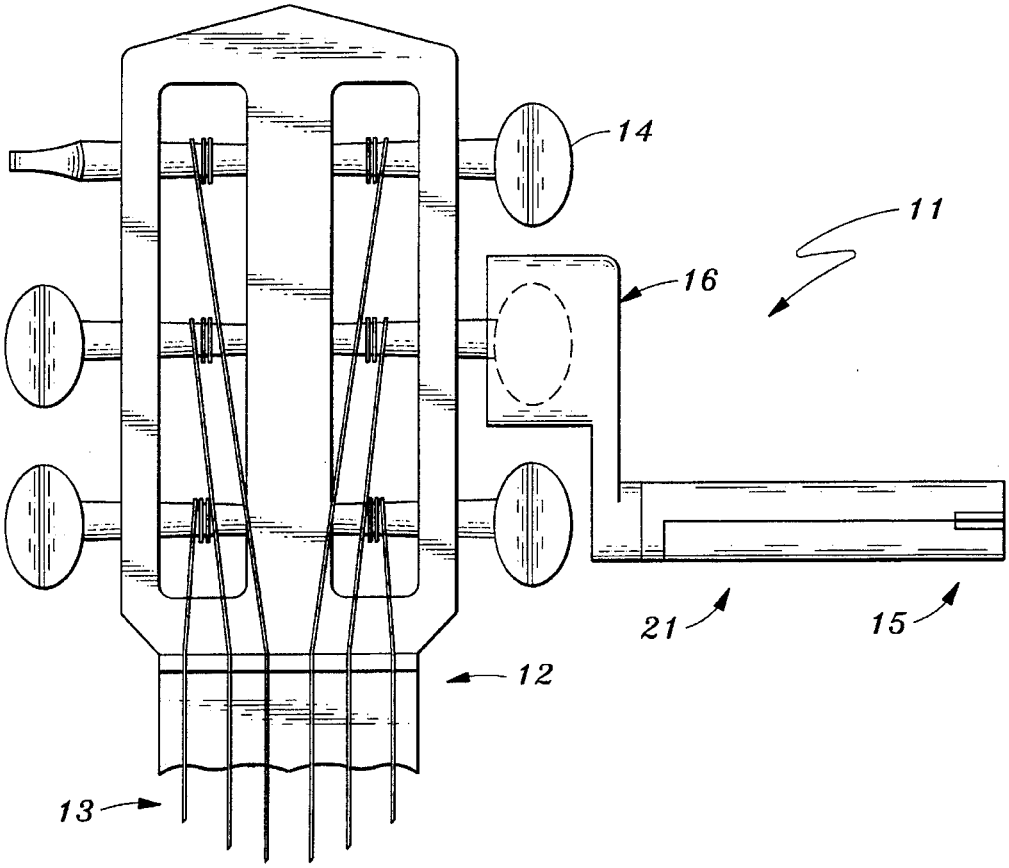
FIG. 1 is a frontal view of the tuning peg region of a guitar illustrating use of the present invention to facilitate turning of the pegs.

Referring initially to FIG. 1 of the drawings, an accessory 11 embodying the invention is used with a musical instrument 12 of the type which has strings 13 formed of any of variety of different materials such as nylon, metal wire or catgut for example and which are engaged by tuning pegs 14. In instruments 12 of this type, the pegs 14 must be manually turned to wind the strings 13 onto the peg and to tension and tune the strings. The instrument 12 of FIG. 1 is a guitar but it should recognized that the accessory 11 is equally adaptable to a variety of other stringed instruments of which violins, violas, cellos and banjos are other examples.

The accessory 11 has a string cutter 15 which will be hereinafter described in more detail. The accessory 11 further facilitates stringing and tuning of the instrument 12 as it may be fitted onto the heads of the tuning pegs 14 and then be used as a small crank which provides leverage during turning of the pegs.

Referring jointly to FIGS. 2, 3, 4 and 5, one portion of the accessory 11 is an elongated socket 16 having a face 17 into which a socket cavity 18 extends. Cavity 18 is proportioned to fit onto and receive the blade like head of a musical instrument tuning peg that is traditionally grasped directly with one's thumb and forefinger.

A lever 19 extends sidewardly from socket 16 in a direction generally parallel to the plane of the face 17 of the socket. An elongated handle 21 is attached to lever 19 at a location thereon that is spaced away from socket 16 and extends away from the lever in a direction that is substantially at right angles to the lever. The handle 21 preferably has a circular cross section although this is not essential in all cases.

Figure 6:
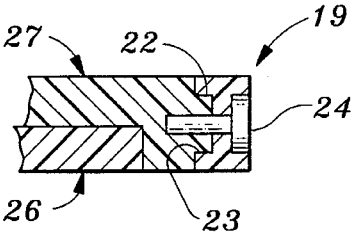
FIG. 6 is a section view taken along line 6—6 of FIG. 2.

The handle 21 may be rigidly attached to lever 19 but is preferably rotatable about an axis which extends at right angles to the lever. For this purpose, with reference to FIGS. 2, 5 and 6, the handle 21 may have a sleeve region 22 of reduced diameter at one end which extends into a conforming chamber 23 in the lever 19. A flanged axle pin 24 extends through the lever 19 and into sleeve region 22 and is secured to the sleeve region by adhesive or other means. Thus the handle 21 need not rotate relative to an operator's hand when it is being used as a crank to turn a tuning peg.

Referring again to FIGS. 2, 3, 4 and 5, handle 21 is formed by a first elongated handle portion 26 and a second elongated handle portion 27 which are linked together by a pivot coupling 28. The first portion 26 is fastened to lever 19 in the manner previously described. The second portion 27, which is slightly shorter than the first portion 26, is not directly fastened to the lever 19 and attaches to the accessory 11 only through the pivot coupling 28. Thus the second handle portion 27 may be pivoted between a first orientation, shown in solid lines in the drawings, at which it extends in parallel side by side relationship with the first handle portion 26 and a second orientation, shown in dashed lines, at which it is angled relative to the first handle portion.

In this particular example of the invention, the division between the first and second handle portions 26 and 27 is at a plane which extends along the centerline of the handle 21. Thus the two handle portions 26 and 27 are each of semicircular cross section except that the first handle portion has a step 29 near lever 19 at which it becomes of circular cross section. This enables the two handle portions 26 and 27 to fit together and jointly form an elongated handle 21 of round cross section when the second handle portion is at the above described first orientation. Pivot coupling 28 may be at any location along the second handle portion 27 but is preferably at a location which is intermediate between the ends of that handle portion.

Figure 4:
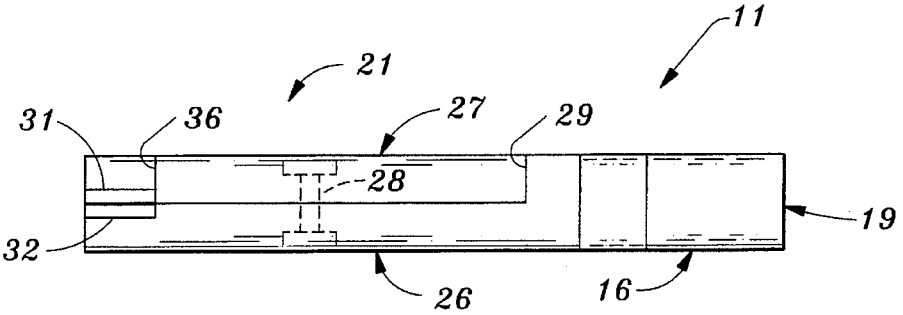
FIG. 4 is a view of the side of the accessory which is the underside when the accessory is in the orientation shown in FIG. 1.
Figure 7:
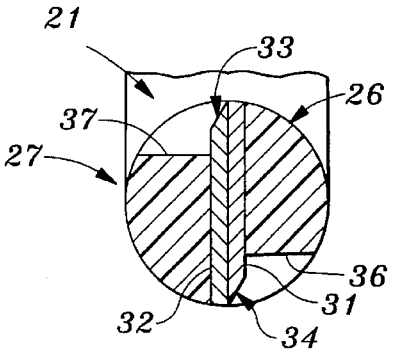
FIG. 7 is a cross section view taken along line 7—7 of FIG. 2.

The string cutter 15 includes a pair of inserts 31 and 32 which are situated at the ends of handle portions 26 and 27 that are remote from lever 19 in this example although the inserts may be at other locations along the handle that are spaced away from pivot coupling 28. Referring to FIGS. 4 and 7 in conjunction, the inserts 31 and 32 are secured to the facing surfaces of handle portions 26 and 27 respectively in position to be disposed against each other in parallel relationship when the handle portions are themselves in parallel relationship. Insert 31 has a sharp cutting edge 33 and insert 32 has a sharp cutting edge 34, the cutting edges being at opposite sides of handle 21 when the handle portions 26 and 27 are in the parallel relationship. Handle portions 26 and 27 have recesses 36 and 37 respectively which are adjacent the cutting edges 34 and 33 so that the cutting edges need not protrude from the surface of handle 21 when the handle portions are in the parallel relationship.

Figure 8:
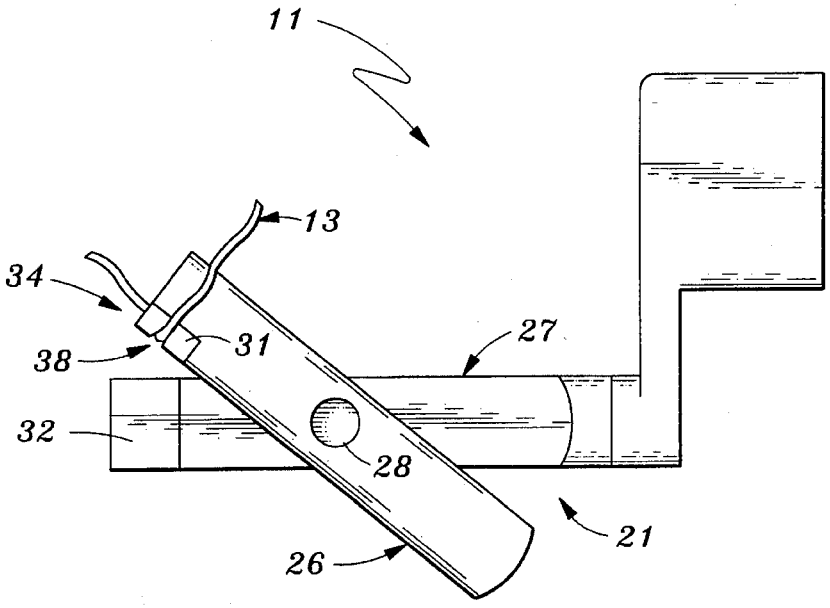
FIG. 8 is another side view of the accessory illustrating use of the accessory for cutting strings for a musical instrument.
Figure 3:
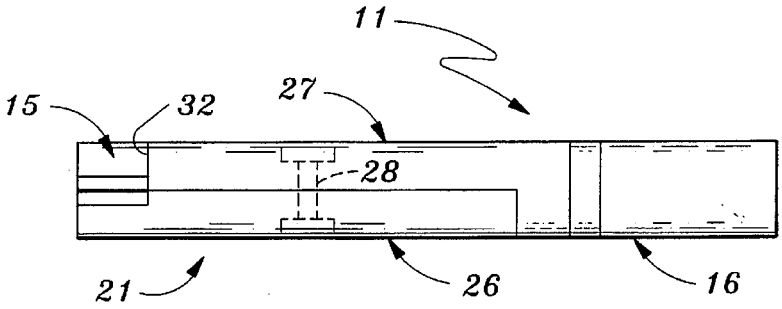
FIG. 3 is a view of the side of the accessory which is uppermost when the accessory is in the orientation shown in FIG. 1.
Figure 2:
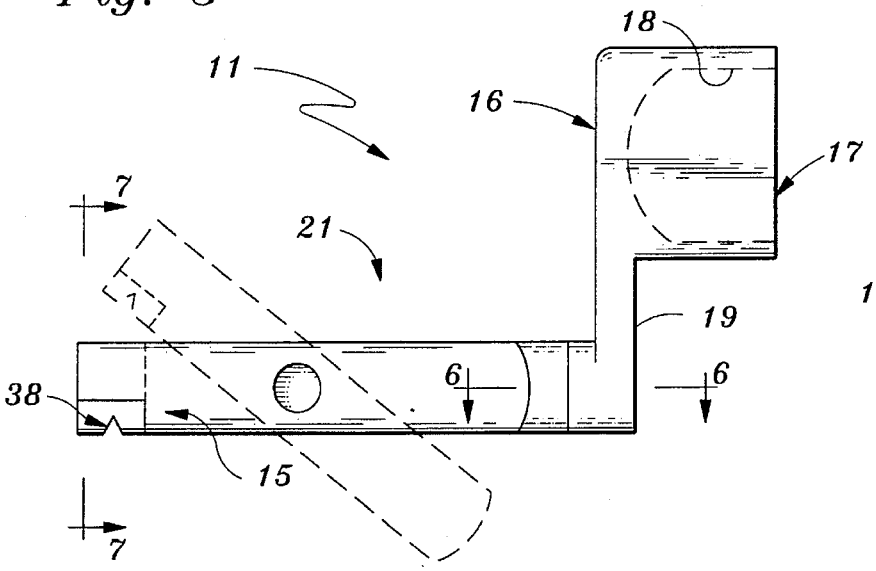
FIG. 2 depicts one side of an accessory embodying the invention.
Figure 5:
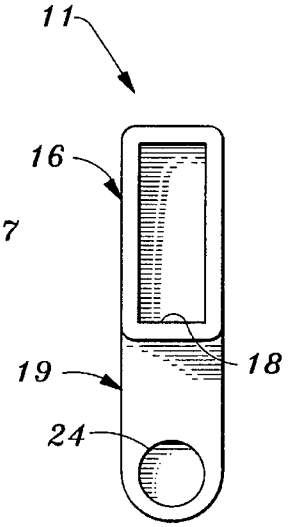
FIG. 5 is an end view of the accessory of FIG. 1 showing a peg receiving socket of the accessory.

Referring now to FIG. 8, the accessory 11 is used to cut the strings 13 of a musical instrument by pivoting the second handle portion 26 into its angled relationship with the first handle portion 27. The string 13 is then placed between the two cutting edges 33 and 34. Pivoting of the second handle portion 27 back to its parallel relationship with first handle portion 26 causes the edges 33 and 34 to cut through the string 13. Retention of the string 13 at the proper location for the cutting operation can be aided by providing a string receiving notch 38 in one of the cutting edges such as in cutting edge 34 in this example.

The socket 16, lever 19 and handle portions 26 and 27 of accessory 11 can be formed of any of various materials such as die-cast aluminum, plastic or the like. Inserts 31 and 32 may be formed of harder material such as carbide for example. If the handle portions 26 and 27 are formed of sufficiently hard material, such as a hard steel for example, the cutting edges 38 and 34 may be formed on the handle portions themselves rather than being on separate inserts 31 and 32.

While the invention has been disclosed with reference to a single embodiment for purposes of example, many modifications and variations of the accessory construction are possible and it is not intended to limit the invention except as defined in the following claims.

I claim:

1. An accessory for facilitating installation of strings on stringed musical instruments which have turnable pegs that engage the strings, said accessory having an elongated socket proportioned to fit onto a peg of the instrument and having a lever extending from the socket for facilitating turning of the peg, wherein the improvement comprises a string cutter secured to said accessory.

2. The accessory of claim 1 wherein said lever has a first end which is adjacent to said socket and a second end which is remote from said socket, further including a handle extending from second end of said lever and being angled relative thereto, said lever and said handle jointly forming a crank for facilitating turning of said accessory and said peg, said string cutter being a component of said handle.

3. The accessory of claim 2 wherein a first portion of said handle is attached to said lever and extends away therefrom and a second portion of said handle is pivoted to said first portion thereof, said second portion of said handle being pivotable between one orientation at which said second portion extends in parallel relationship with said first portion and another orientation at which said second portion is angled relative to said first portion and wherein one of said handle portions has a cutting edge positioned to contact the other portion of said handle as said second portion is pivoted towards said one orientation.

4. The accessory of claim 3 wherein said cutting edge has a notch therein into which strings of said musical instrument may be entered.

5. The accessory of claim 3 wherein said handle including said first and second portion thereof and said cutting edge are coupled to said lever by means for enabling rotation of said handle relative to said lever.

6. The accessory of claim 3 wherein said first and second portions of said handle jointly form an elongated rod of circular cross section when said second portion of said handle is at said one orientation thereof.

7. The accessory of claim 6 wherein said second portion of said handle has opposite ends and wherein said second portion of said handle is coupled to said first portion thereof by a pivot which is situated away from each of said opposite ends of said second portion.

8. The accessory of claim 6 wherein said first and second portions of said handle each have a semicircular cross section.

9. The accessory of claim 2 wherein a first portion of said handle is attached to said lever and extends away therefrom and a second portion of said handle is pivoted to said first portion thereof, said second portion of said handle being pivotable between one orientation at which said second portion extends in parallel relationship with said first portion and another orientation at which said second portion is angled relative to said first portion and wherein each of said handle portions has a cutting edge, said cutting edges being positioned to be in sliding contact with each other as said second portion is pivoted towards said one orientation.

10. The accessory of claim 9 wherein said first and second portions of said handle are formed of a first material and wherein each of said handle portions has an insert seated in said first material wherein said cutting edges are edges of said inserts, said inserts being formed of material that is harder than the material of said first and second portions of said handle.

11. The accessory of claim 1 further including an elongated handle attached to said lever at a location thereon which is spaced apart from said socket and which extends away from said lever substantially at right angles thereto, said handle having a first handle portion which is directly attached to said lever and a pivoting second handle portion which extends alongside said first portion at one orientation of the second portion and which extends at an angle relative to the first portion at another orientation of the second portion, said second portion of said handle being attached to said first portion thereof by a pivot coupling and wherein said string cutter includes sharp cutting edges situated at corresponding locations on each of said handle portions at locations which cause said cutting edges to contact each other as said second handle portion is pivoted towards said one orientation thereof.

12. An accessory for facilitating installation of strings on stringed musical instruments which have turnable pegs that engage the strings comprising:

a socket having a face with an elongated opening proportioned to engage said pegs, a lever extending outward from said socket, an elongated handle attached to said lever at a location thereon that is spaced apart from said socket which handle extends in a direction that is substantially at right angles to said face of said socket, said handle having a first handle portion which is directly attached to said lever and a pivoting second handle portion which extends alongside said first portion at one orientation of the second portion and which extends at an angle relative to the first portion at another orientation of the second portion, said second portion of said handle being attached to said first portion thereof by a pivot coupling, and first and second cutting inserts secured to said first and second handle portions respectively at corresponding locations thereon which locations are spaced away from said pivot coupling, said cutting inserts having sharp cutting edges located to be in sliding contact with each other as said second handle portion is pivoted toward said one orientation thereof.

* * * * *